US006755223B1

(12) United States Patent
Trebbi et al.

(10) Patent No.: US 6,755,223 B1
(45) Date of Patent: Jun. 29, 2004

(54) AUTOMATIC MACHINE FOR FILLING BOTTLES WITH POWERED MATERIAL AND THE RELATIVE DRIVE MECHANISM

(75) Inventors: Claudio Trebbi, Medicina (IT); Gabriele Gabusi, Castenaso (IT)

(73) Assignee: I.M.A. Industria Macchine Automatiche S.p.A., Ozzano Emilia ( * ) Notice: Subject to any disclaimer, the term of this patent is extended or adjusted under 35 U.S.C. 154(b) by 0 days.

(21) Appl. No.: 10/311,354

(22) PCT Filed: May 10, 2002

(86) PCT No.: PCT/IB02/01640

§ 371 (c)(1),
(2), (4) Date: Jan. 7, 2003

(87) PCT Pub. No.: WO02/092430

PCT Pub. Date: Nov. 21, 2002

(30) Foreign Application Priority Data

May 15, 2001 (IT) ..... BO2001A0300

(51) Int. Cl.[7] ..... B65B 1/04
(52) U.S. Cl. ..... 141/129; 141/67; 141/144
(58) Field of Search ..... 141/67, 11, 12, 141/70, 71, 81, 86, 93, 121–123, 125, 286, 2; 222/368, 152, 636

(56) References Cited

U.S. PATENT DOCUMENTS 4,509,568 A * 4/1985 Kawaguchi et al. ..... 141/129
4,671,430 A * 6/1987 Dinius ..... 222/135
6,122,984 A 9/2000 Willmot
6,283,176 B1 * 9/2001 Wurst et al. ..... 141/144

FOREIGN PATENT DOCUMENTS

DE 199 15 259 A 1 10/2000
EP 0 678 449 A1 10/1995

* cited by examiner

*Primary Examiner*—Steven O. Douglas
(74) *Attorney, Agent, or Firm*—Arent Fox

(57) ABSTRACT

A machine (1) for filling bottles (2) fed in succession with intermittent motion along a preset path (3) with powdered material comprises a filling station (4) with at least one pair of power dosing disks (5), located above the bottle (2) path (3), rotating intermittently in one direction about their geometric axes (10), and having radial cavities (7) and pistons (8) which together form spaces for receiving, transferring and unloading dosed quantities of powders into the bottles (2). The pistons (8) move axially in the cavities (7) to vary the powder dosing spaces. The machine (1) also comprises drive means (6, 9) for the dosing disks (5), adjustment means (20, 11, 12) for the relative dosing spaces and a remote control mechanism (13, 14) for the adjustment means (20, 11, 12), located together with the drive means (6, 9) on the same side of the pair of dosing disks (5). An epicyclic gear train (13, 14, 16, 17), for producing an angular offset between each dosing disk (5) and a relative disk (20) for volumetric adjustment of the powders which is connected to it, is an integral part of the present invention.

12 Claims, 2 Drawing Sheets

AUTOMATIC MACHINE FOR FILLING BOTTLES WITH POWERED MATERIAL AND THE RELATIVE DRIVE MECHANISM

TECHNICAL FIELD

The present invention relates to the automated filling of bottles with powders or granulated solid substances, and in particular relates to a machine for filling bottles with powdered pharmaceutical substances dosed and prepared in—a sterile environment and a drive mechanism which is part of the machine.

BACKGROUND ART

At present the aseptic filling of bottles or vials with powdered pharmaceutical substances is carried out using machines which each basically comprise filling or dosing, weighing and capping operating stations, suitably arranged are n intermittent feed path for the bottles to be filled, which are weighed, filled, weighed again and capped in sequence.

The operating station to which the present invention makes specific reference is the bottle filling or dosing station, which basically comprises at least one powder dosing disk, attached to the bottom of a powder feed hopper. The disk is located above the empty bottle feed path and rotates in one direction about a geometric axis, driven by suitable drive means with intermittent rotary motion and synchronised with the bottle feed movement.

The dosing disk has radial cavities and pistons inside the cavities, which, together with the latter, form spaces for receiving, transferring and unloading powders which, taken from the hopper, are dosed and inserted in the bottles fed below the disk.

The dosing disk pistons move with axial alternating motion inside the cavities, to vary the disk dosing spaces which receive the powders upon activation of suitable dosing space adjustment means, which can be activated from a remote control mechanism.

More specifically, the adjustment mechanisms are controlled by the weighing stations which, at statistical time intervals, weigh the bottles first when empty and then when full, and send the values to a dedicated computer which, if necessary, provides feedback with a command for the adjustment means which simultaneously and automatically corrects all powder dosing spaces.

A machine of the known type described above normally has a system for automatic adjustment of the weight with means for adjusting the dosing disk dosing spaces which comprise an adjustment disk, mounted so that it rotates integrally with the dosing disk, and having a substantially spiral groove in which pads engage. The pads are connected to the dosing disk pistons. A rotation of the grooved disk relative to the dosing disk produces the alternating motion of the pistons and, therefore, adjusts dosing.

The adjustment means control mechanism is currently made using a complex combination of harmonic reduction gears which are directly attached to the dosing disk and are located on the side opposite that from which the rotary motion of the disks originates.

Such a configuration, which has long been used with satisfactory results, causes disadvantages.

In particular, the position of the control mechanism relative to the dosing disk means that, if an operator wants access to the disk to carry out normal cleaning and/or maintenance operations, he or she must first remove the entire control mechanism.

This involves an obvious operating complication, as well as long periods required for the work, and, given the considerable weight of the parts to be removed, even difficult and dangerous handling.

Moreover, in particular, the current control mechanism involves a significant longitudinal dimension relative to the bottle feed path, meaning that the zones immediately downstream and upstream of the bottle filling station are difficult to access for maintenance work.

DISCLOSURE OF THE INVENTION

The aim of the present invention is, therefore, to overcome the above-mentioned disadvantages by providing a machine which can allow easier and more rapid access to the bottle filling station, without the need to remove the dose adjustment control mechanism during maintenance and/or cleaning operations.

Another aim of the present invention is to allow a noticeable reduction in the overall dimensions of the filling stations, in the direction longitudinal to the bottle feed path, to minimise the dimensions in particular above the bottle infeed opening.

Accordingly, the present invention fulfils the preset aims by providing a machine for automatically filling bottles with powdered material, in which the bottles to be filled are fed in succession, with an intermittent motion, along a preset path. The machine comprises at least one filling station with at least one powder dosing disk, located above the bottle path, with intermittent rotation in one direction about its geometric axis and having radial cavities and pistons contained in the cavities, which together with the latter form spaces which receive, transfer and unload dosed quantities of powders into the bottles. The pistons move alternately in the cavities to vary the dosing spaces. The machine has dosing disk drive means and dosing space adjustment means connected to the dosing disk and an adjustment means remote control mechanism. The machine is characterised in that the dosing disk drive means and the adjustment means remote control mechanism are located on the same side of the dosing disk.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment, without limiting the scope of its application, and in which:

DETAILED DESCRIPTION OF THE PREFERRED EMBODIMENTS OF THE INVENTION

Figure 1:
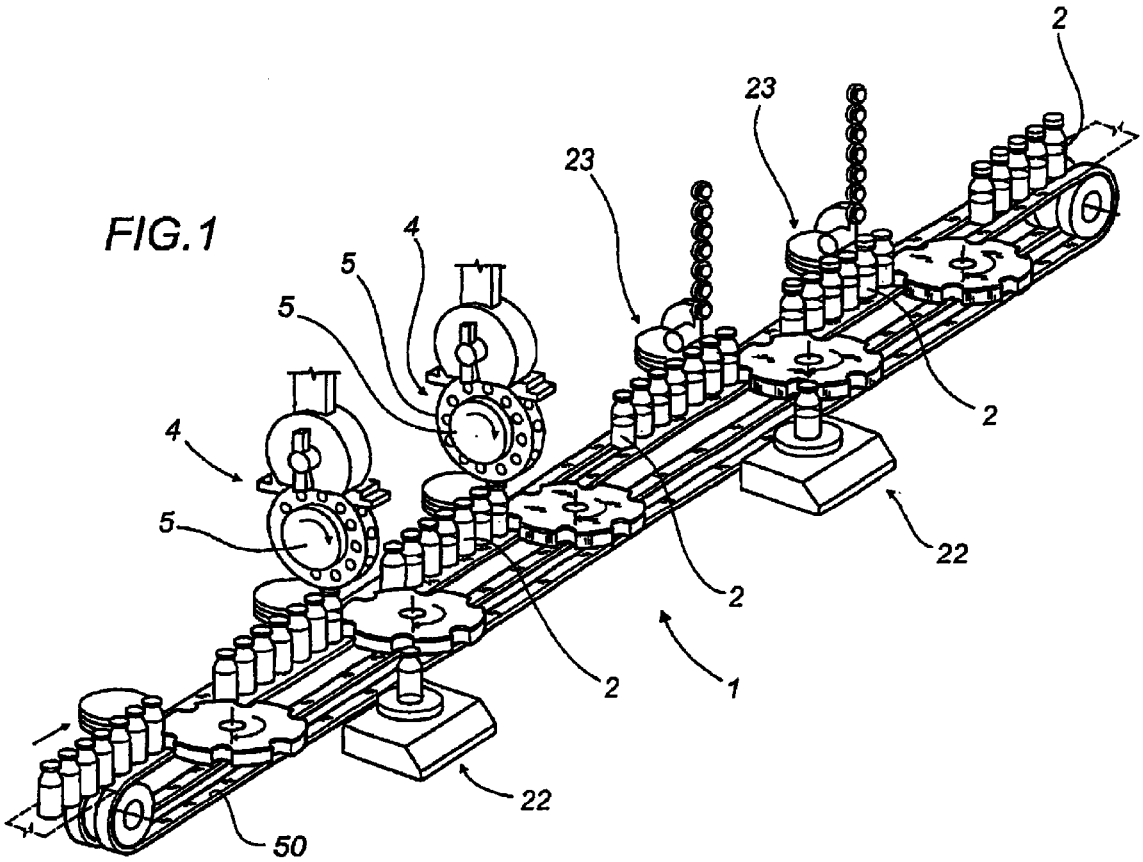
FIG. 1 is a schematic overall view of a bottle filling machine in accordance with the present invention.

With reference to FIG. 1 in the accompanying drawings, the numeral 1 indicates as a whole a machine for automated filling with powders—in particular pharmaceutical substances—microdosed in containers such as bottles 2.

The machine 1 basically comprises operating stations 4, 22, 23 suitably located one after another along a preset straight, horizontal bottle 2 feed path 3 using conveyor means 50 driven with intermittent motion, for the execution, in compliance with a known method, in succession of empty bottle 2 weighing at a first weighing station 22, bottle 2 filling at two filling stations 4 located one after another, a second weighing operation for the full bottles 2 at another weighing station 22 and, finally, bottle capping at two capping stations 23.

Figure 2:
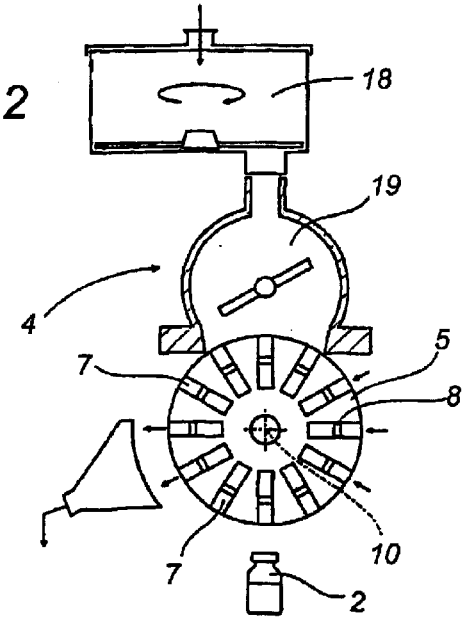
FIG. 2 is a schematic view of a filling or dosing operating station on the machine illustrated in FIG. 1.

As illustrated in FIGS. 1 and 2, the filling stations 4, to which the present invention expressly refers, each basically comprise powder dosing disks 5, attached to the bottom of a hopper 18 and to a feed device 19 for the pharmaceutical powders. The disks 5 are above the bottle 2 feed path 3.

The dosing disks 5 are driven in a single direction (clockwise in FIG. 1) by suitable drive means that provide intermittent rotary motion about an axis of symmetry 10 and synchronised with the feed motion of the bottles 2 below.

Figure 4:
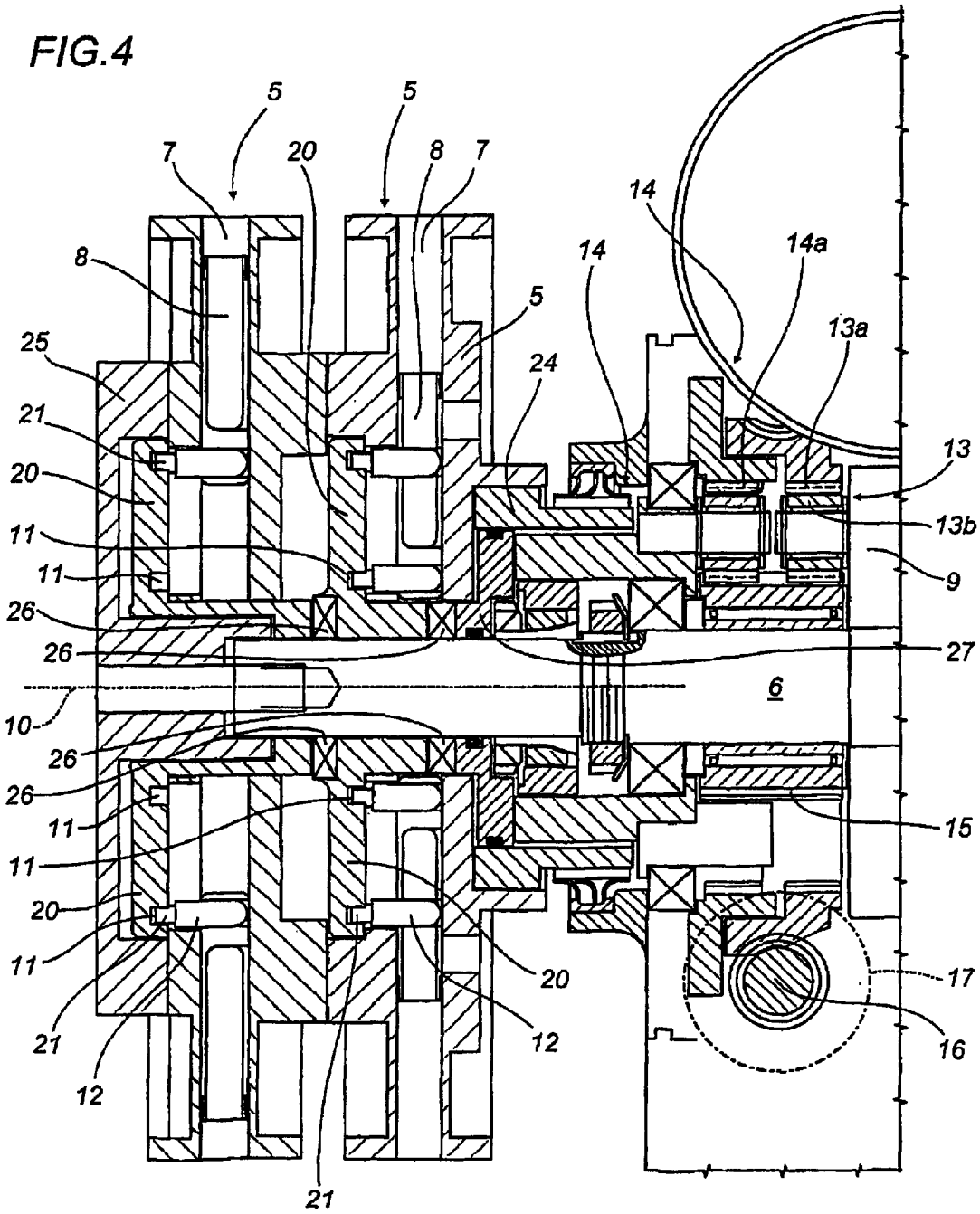
FIG. 4 is an overall view in cross-section according to a plane longitudinal with the bottle feed path, of a machine according to the present invention.

The drive means, as illustrated in the detailed FIG. 4, comprise a horizontal shaft 6 which, preferably and by way of example, supports four dosing disks 5 at its opposite ends.

The four disks 5 are attached in pairs and are keyed together to the shaft 6. They are rigidly attached to the shaft by a front connecting flange 24,and a guard 25, bolted at the axis of the shaft 6. The latter is connected integrally and centrally to a substantially star-shaped outfeed part 9 of an intermittent drive device. The part 9, therefore, acts as an actuator for the shaft 6 drive means.

As illustrated in FIGS. 2 and 4, the dosing disks 5 have radial cavities 7 and pistons 8 contained in the cavities 7, which together with the latter form spaces for receiving, transferring and unloading powders which are micrometrically dosed in the disk 5 cavities 7 and then transferred into the bottles 2.

The dosing disk 5 pistons 8 move with alternating axial motion in the cavities 7 to vary the dosing spaces, according to the quantity of powders to be inserted in the bottles 2. This volumetric adjustment is carried out with the activation of suitable adjustment means controlled according to processing performed, for example, by a control unit which processes the weight data for the empty and full bottles 2 fed along the path 3.

Figure 3:
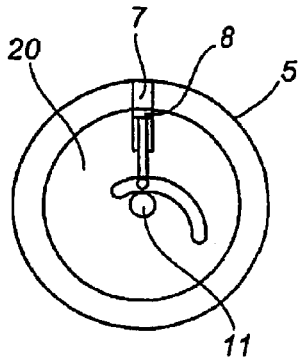
FIG. 3 is a schematic view of the dosing space adjustment means illustrated in FIG. 1.

The volumetric adjustment means conventionally comprise an adjustment disk 20—schematically illustrated in FIG. 3—which is mounted coaxial to a corresponding dosing disk 5 and has a groove 11 preferably with the shape of an archimedean spiral, in which a pad 21 engages and slides. The pad is integral with a pin 12 which moves the piston 8 in its cavity 7. Rotation of the adjustment disk 20 relative to the dosing disk 5, about the shared axis of symmetry 10, therefore produces, when one disk 20 is offset relative to the other disk 5, bi-directional alternating movement of the pistons 8 inside the cavities 7. Depending on the directions of rotation set for the adjustment disk 20 and the dosing disk 5, this increases or reduces the spaces available for the individual doses of powdered product.

The command for the above-mentioned volumetric adjustment means is transmitted by a remote control mechanism, which is located on the same side as the shared drive means 6 and 9 for the disks 5, 20 relative to the position of the dosing disks 5 and the adjustment disks 20.

Considering that FIG. 4 illustrates a dosing station 4 with four dosing disks 5 positioned symmetrically relative to the centre line of the filling station 4 and combined in pairs, such a remote control mechanisms may be described by limiting observations to the left-hand side of FIG. 4, which shows such a mechanism collectively controlled by the volumetric adjustment means of the two left-hand dosing disks 5. Obviously, references to this part of the dosing station 4 may be repeated identically for the right-hand side of FIG. 4.

Starting from the centre line of the dosing station 4, it may be observed that the remote control mechanism—labelled 13 and 14 as a whole—is positioned concentrically above the support shaft 6 for the pairs of disks 5, 20 and is connected between the shaft 6 drive unit actuator 9 on the observer's right (that is to say, the intermittent drive device star-wheel 9, previously defined) and the pair of adjacent dosing 5 and adjustment disks 20 on the observer's left.

In particular, the control mechanism comprises a pair of epicyclic gear trains 13, 14 connected to one another and respectively one to the actuator part 9 and the other to the dosing space adjustment means 11, 12 of each of the dosing disks 5. The adjustment means 11, 12 are connected to one another in parallel, for each of the dosing disks 5 which control them, by means of front feed teeth 26.

The two epicyclic gear trains 13, 14 are connected to one another in series and have gear ratios which are respectively equal and inverted, so that the total gear ratio of the entire mechanism is 1:1.

As illustrated in FIG. 4, the first epicyclic gear train 13 of each pair of gear trains 13, 14 comprises a planetary gear 15, with external teeth, which is supported, in conditions of free rotation about its geometric axis, by the dosing disk 5 support shaft 6. The first epicyclic gear train also comprises a first crown gear 13*a* with internal teeth, coaxial to the planetary gear 15, and at least one first satellite gear 13*b* which simultaneously engages with the planetary gear 15 and with the first crown gear 13*a*, and which is turned about the planetary gear 15 by the actuator—star-wheel part 9 which is fixed to the shaft 6.

Similarly, the second gear train 14 of the pair of gear trains 13, 14 comprises a second crown gear 14*a* with internal teeth, coaxial to the planetary gear 15 and fixed to a second satellite gear 14*b*, which also simultaneously engages with the planetary gear 15 of the first gear train 13 and with the second crown gear 14*a* and is connected, with integral rotation and by means of a suitable connecting flange 27, to adjustment disks 20 for the pair of dosing disks 5 on the left of FIG. 4.

There are control means for relative angular movements of the first crown gear 13*a*, which make the adjustment means 11, 12 produce variations in the dosing spaces of the dosing disks 5.

As illustrated again in FIG. 4, the crown gear 13*a* angular movement control means preferably comprise a worm screw 16 and a worm gear 17, which mesh with one another and are connected to the first crown gear 13*a*.

Thanks to the fact that the drive means 6, 9 and the remote control mechanism means 13, 14 are located on the same side of the disks 5 and the adjustment disks 20, said disks 5, 20 are easily accessed, in particular for simple disk 5, 20 maintenance and cleaning on the side opposite that on which the drive means 6, 9 and remote control mechanism 13, 14 are located.

This provides various advantages, such as easy, rapid access to the dosing disks 5 without the need to remove the adjustment mechanisms 13, 14 which are, therefore, left in place.

Eliminating the disassembly procedure for these elements also saves time and effort, allowing a considerable reduction in the parts which must be handled during the disassembly, maintenance and reassembly of the parts in question. This makes cleaning and maintenance more rapid, easier, less laborious and much safer.

Positioning the drive means and the remote control mechanism 13, 14 on the same side also allows the modular structuring of the dosing stations 4 which, in a rapid and easy fashion, can be set up with numerous configurations, for example differing in the number, combinations and arrangements of the dosing disks 5 and adjustment means 11, 12.

Moreover, the structuring of the remote control mechanism in such a way that it includes the pair of epicyclic gear trains 13, 14 with a cascade connection, allows dosing adjustments to be made with continuous dosing space modulation and without having to stop the machine 1.

Moreover, such a control mechanism 13, 14 permits the construction of compact dosing stations 4, smaller than those already known, particularly in the direction longitudinal to the bottle 2 path 3, making the zones immediately downstream and upstream of the stations 4 accessible for maintenance work.

The invention described can be subject to numerous modifications and variations without thereby departing from the scope of the inventive concept. Moreover, all the details of the invention may be substituted by technically equivalent elements.

What is claimed is:

1. A machine (1) for automatically filling bottles (2) with powdered material, in which the bottles (2) to be filled are fed in succession, with intermittent motion, along a preset path (3), the machine (1) comprising at least one filling station (4) having at least one powder dosing disk (5), located above the bottle (2) path (3), the disk being driven with intermittent rotation in one direction about its geometric axis (10) and having radial cavities (7) with pistons (8) contained in the cavities (7), the cavities and pistons forming spaces for receiving, transferring and unloading dosed quantities of powders into the bottles (2), the pistons (8) being alternately mobile in the cavities (7) to vary the dosing spaces; the machine (1) having drive means (6, 9) for the dosing disk (5) and adjustment means (20, 11, 12) for the dosing spaces connected to the dosing disk (5) and a remote control mechanism (13, 14) for the adjustment means (20, 11, 12); the machine (1) being characterised in that the drive means (6, 9) for the dosing disk (5) and the remote control mechanism (13, 14) for the adjustment means (20, 11, 12) are located on the same side of the dosing disk (5).

2. The machine according to claim 1, characterised in that the remote control mechanism (13, 14) is controlled by the adjustment of the dosing of at least two of the dosing disks (5).

3. The machine according to claim 1, characterised in that the drive means (6, 9) comprise a support shaft (6) for a dosing disk (5) driven with intermittent rotation, and an actuator part (9) which drives the shaft (6) and the remote control mechanism (13, 14); the remote control mechanism (13, 14) being parallel with the support shaft (6) and positioned between the actuator part (9) and a dosing disk (5).

4. The machine according to claim 3, characterised in that the remote control mechanism comprises a pair of epicyclic gear trains (13, 14) connected to one another and respectively one to the actuator part (9) and the other to the adjustment means (20, 11, 12) for the dosing disk (5) dosing spaces.

5. The machine according to claim 4, characterised in that the epicyclic gear trains (13, 14) are connected to one another in series and have gear ratios which are equal and respectively inverted.

6. The machine according to claim 4 or 5, characterised in that a first epicyclic gear train (13) in the pair of gear trains (13, 14) comprises a planetary gear (15), with external teeth, a first crown gear (13*a*), with internal teeth, being coaxial to the planetary gear (15), and at least one first satellite gear (13*b*); the first satellite gear (13*b*) simultaneously engaging with the planetary gear (15) and with the first crown gear (13*a*), a second gear train (14) in the pair of gear trains (13, 14) comprising a second crown gear (14*a*), with internal teeth, being coaxial to the planetary gear (15) and fixed, and at least one second satellite gear (14*b*) connected to a flange (27); the second satellite gear (14*b*) simultaneously engaging with the planetary gear (15) and with the second crown gear (14*a*) and being connected with integral rotation to adjustment means (20, 11, 12) for the dosing disk (5) dosing spaces; the first satellite gear (13*b*) being connected to the actuator part (9) which turns the planetary gear (15) which, in turn, turns the second satellite gear (14*b*).

7. The machine according to claim 6, characterised in that it comprises control means (16, 17) designed to produce relative angular movements of the first and second crown gears (13*a*, 13*b*), which make the adjustment means (20, 11, 12) produce variations in the dosing disk (5) dosing spaces.

8. The machine according to claim 7, characterised in that the control means for the relative angular movements of the first and second crown gears (13*a*, 13*b*) comprise a worm screw (16) and a worm gear (17), engaging with one another and respectively connected to the first (13*a*) and second (13*b*) crown gears.

9. The machine according to claim 6, characterised in that the planetary gear (15) is supported in a condition of free rotation about its geometric axis (10) by the dosing disk (5) support shaft (6).

10. The machine according to claim 2, characterised in that the drive means (6, 9) comprise a support shaft (6) for a dosing disk (5) driven with intermittent rotation, and an actuator part (9) which drives the shaft (6) and the remote control mechanism (13, 14,); the remote control mechanism (13, 14) being parallel with the support shaft (6) and positioned between the actuator part (9) and a dosing disk (5).

11. The machine according to claim 7, characterised in that the planetary gear (15) is supported in a condition of free rotation about its geometric axis (10) by the dosing disk (5) support shaft (6).

12. The machine according to claim 8, characterised in that the planetary gear (15) is supported in a condition of free rotation about its geometric axis (10) by the dosing disk (5) support shaft (6).

* * * * *